US011370644B1

(12) United States Patent
Hamlik et al.

(10) Patent No.: US 11,370,644 B1
(45) Date of Patent: Jun. 28, 2022

(54) ADJUSTABLE LOAD HANDLER FOR MOUNTING ON LIFT TRUCKS WITH DIFFERENT TYPES OF STANDARD CARRIAGES

(71) Applicant: Rightline Equipment, Inc., Rainier, OR (US)

(72) Inventors: Jim D. Hamlik, Vancouver, WA (US); Joel D. Hamlik, Vancouver, WA (US); Cameron R. Burak, Vancouver, WA (US)

(73) Assignee: RIGHTLINE EQUIPMENT, INC., Rainier, OR (US)

( * ) Notice: Subject to any disclaimer, the term of this patent is extended or adjusted under 35 U.S.C. 154(b) by 0 days.

(21) Appl. No.: 16/724,148

(22) Filed: Dec. 20, 2019

Related U.S. Application Data

(60) Provisional application No. 62/784,368, filed on Dec. 21, 2018.

(51) Int. Cl.

| | |
|---|---|
| ***B66F 9/14*** | (2006.01) |
| ***B66F 9/20*** | (2006.01) |
| ***B66F 9/10*** | (2006.01) |
| ***B66F 9/18*** | (2006.01) |

(52) U.S. Cl.
CPC ..... *B66F 9/14* (2013.01); *B66F 9/10* (2013.01); *B66F 9/18* (2013.01); *B66F 9/205* (2013.01)

(58) Field of Classification Search
CPC ..... B66F 9/14; B66F 9/10; B66F 9/18; B66F 9/205; B66F 9/12; B66F 9/195; B66F 9/148; B66F 9/146; B66F 9/22; B66F 9/147; B66C 1/10
See application file for complete search history.

(56) References Cited

U.S. PATENT DOCUMENTS

| | | | | |
|---|---|---|---|---|
| 5,299,857 | A * | 4/1994 | Zanetis | E01C 23/088 111/101 |
| 5,368,435 | A * | 11/1994 | Bostad | B66F 9/148 414/667 |
| 5,807,060 | A * | 9/1998 | Hamlik | B66F 9/148 414/668 |
| 2008/0152471 | A1* | 6/2008 | Polvilampi | B66F 9/148 414/671 |
| 2012/0171004 | A1* | 7/2012 | Jones, Jr. | B66F 9/122 414/664 |
| 2019/0241417 | A1* | 8/2019 | Prentice | B66F 9/146 |
| 2019/0337784 | A1* | 11/2019 | Weiss | B66F 9/205 |

* cited by examiner

*Primary Examiner* — Glenn F Myers
(74) *Attorney, Agent, or Firm* — Rylander & Associates, PC; Philip R. M. Hunt

(57) ABSTRACT

An adjustable load handler configured to be mounted on lift trucks with different standard type carriages. The handler comprising a frame assembly, a top hook assembly with a securing mechanism for securing the top hook assembly to the frame assembly in a plurality of positions A center manifold is coupled to the underside of the side shift actuator, with hydraulic connections directly into the side shift actuator. Hydraulic lines coupled to the center manifold and to one or more hydraulic components of the loader have sufficient slack so the top hook assembly can be moved between positions without disconnecting any of these hydraulic lines.

24 Claims, 12 Drawing Sheets

ADJUSTABLE LOAD HANDLER FOR MOUNTING ON LIFT TRUCKS WITH DIFFERENT TYPES OF STANDARD CARRIAGES

CROSS-REFERENCE TO RELATED APPLICATIONS

This application claims the benefit of U.S. Provisional Application No. 62/784,368, filed 2018 Dec. 21, incorporated herein by reference.

TECHNICAL FIELD

The present invention relates to cargo handling equipment. More particularly, the present invention relates to load handler attachments for use primarily with lift trucks.

BACKGROUND

Material handling vehicles such as lift trucks are used to pick up and deliver loads between stations. A typical lift truck 10 has a mast 12, which supports a load-lifting carriage 14 that can be raised along the mast 12 (see FIG. 1). The carriage 14 typically has one or more carriage bars 16 to which a fork frame 18 is mounted. The carriage bars 16 are coupled to the mast in a way that allows the lift truck 10 to move the carriage bars 16 up and down, but not laterally relative to the truck. The fork frame 18 carries a pair of forks 20. An operator of the lift truck 10 maneuvers the forks 20 beneath a load prior to lifting it.

Typical load handlers can be adjusted to fit onto different types of standard lift truck carriages, but the adjustment is not easy and usually requires the lift truck operator get in and out of the cab of the lift truck several times. What is needed is a load handler that is easier to adjust.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

DETAILED DESCRIPTION

In describing the one or more representative embodiments of the inventive subject matter, use of directional terms such as "upper," "lower," "above," "below", "in front of" "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business-related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. As such, the scope of the inventive subject matter should not be limited by the particular embodiments herein described but should be defined only by the appended claims and equivalents thereof.

First Representative Embodiment

Figure 1:
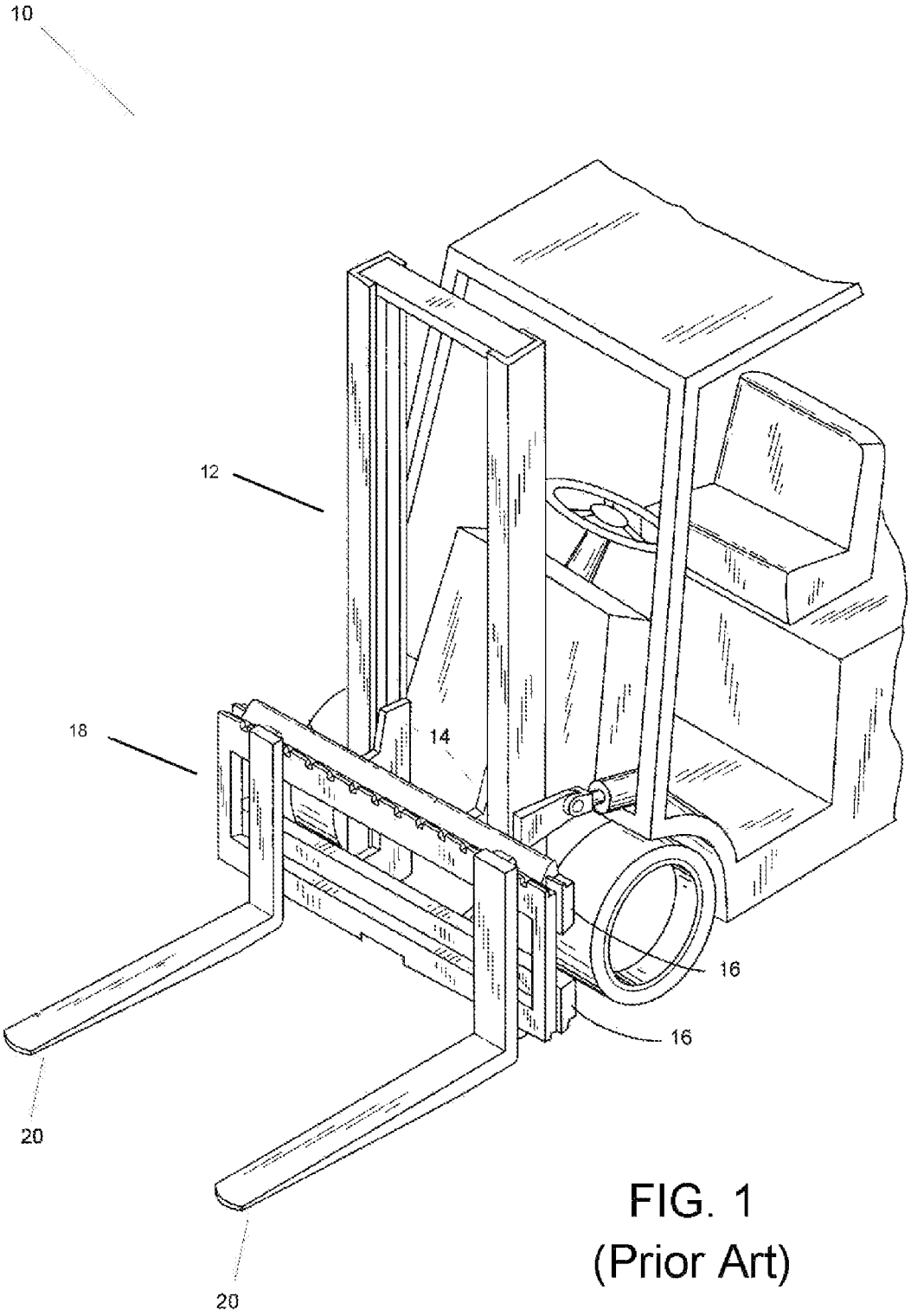
FIG. 1 (Prior Art)
FIG. 1 shows a perspective view of a lift truck (prior art).
Figure 2:
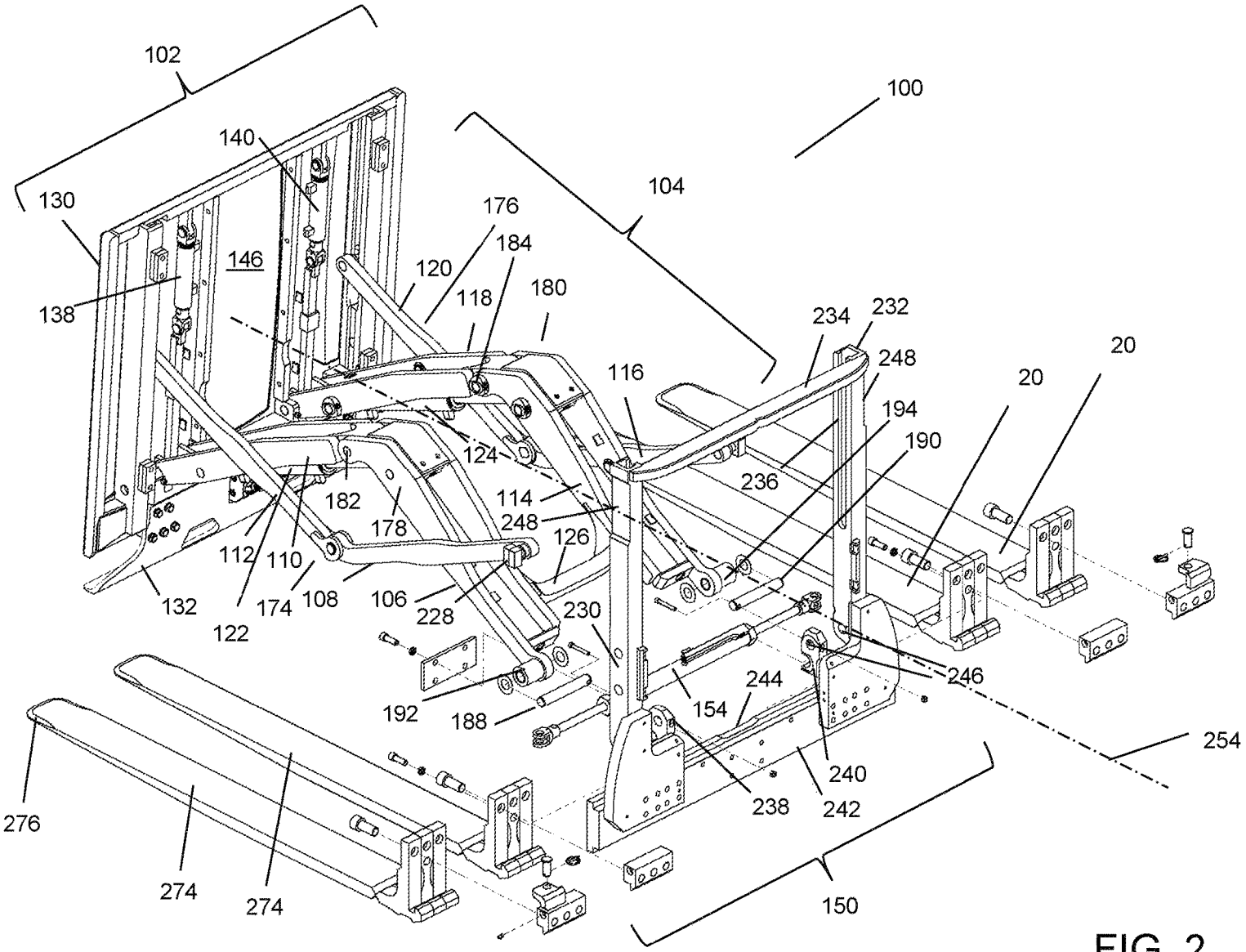
FIG. 2 shows a perspective view of a load handler.
Figure 3:
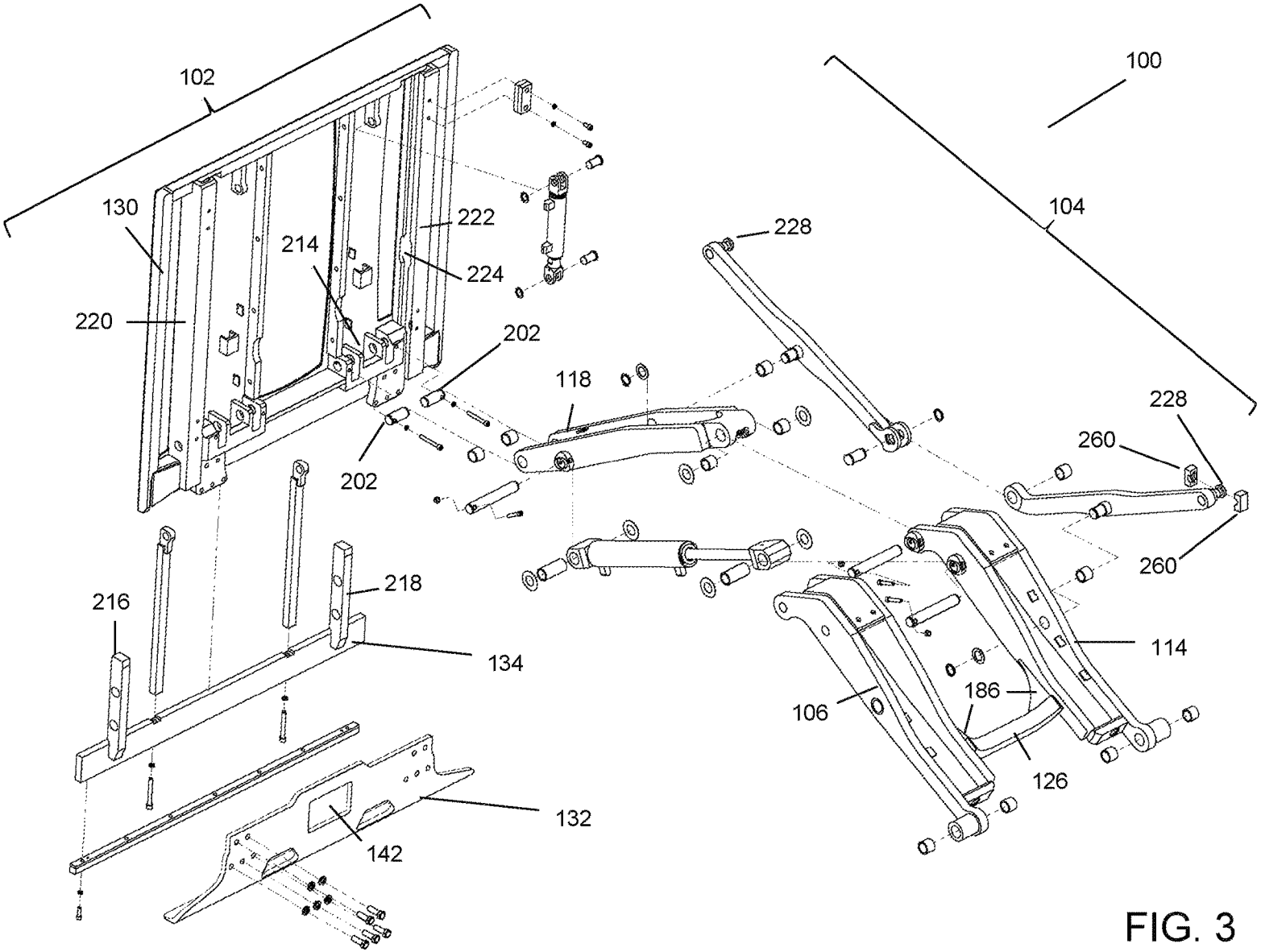
FIG. 3 shows an exploded perspective view of a load handler.
Figure 4:
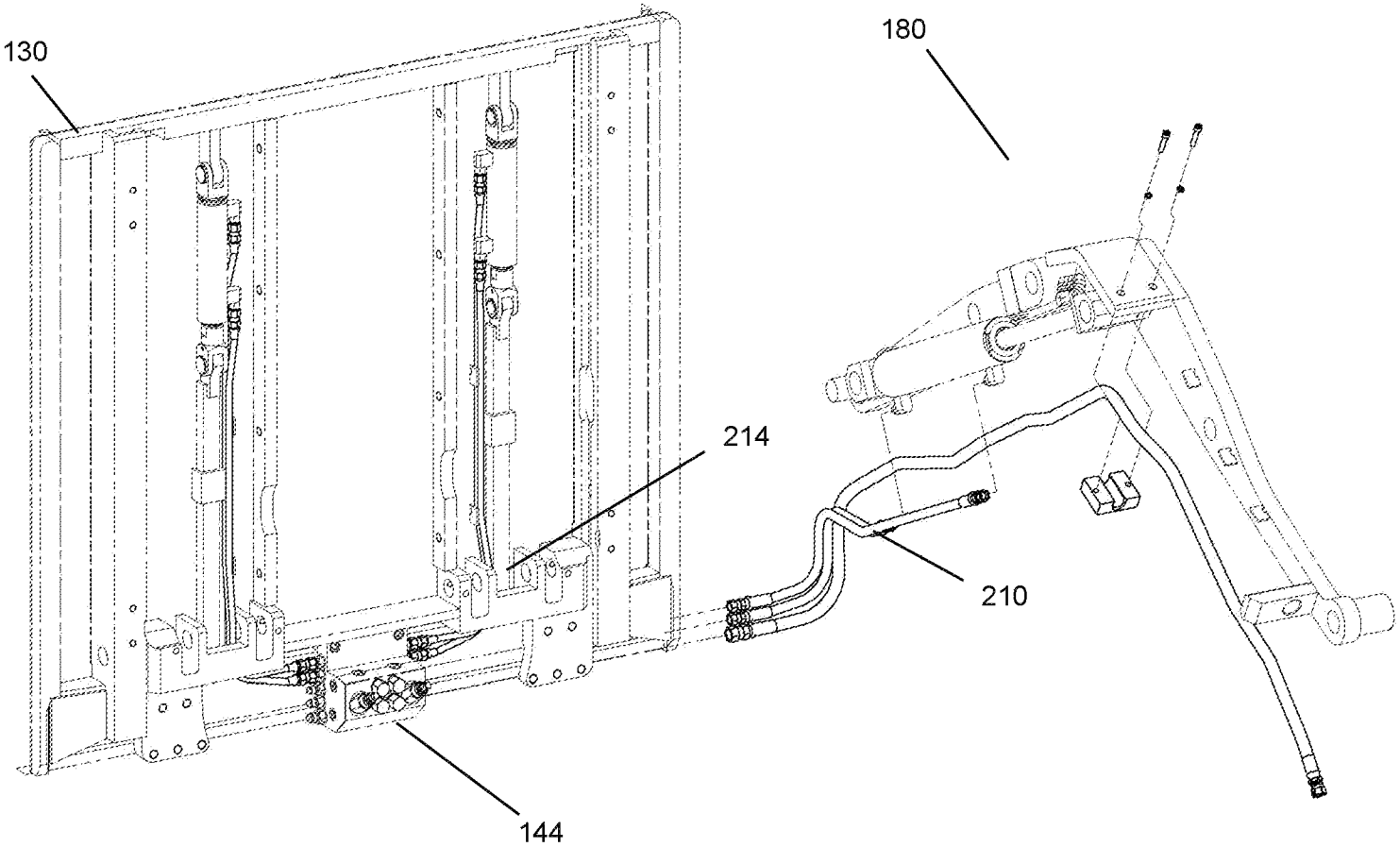
FIG. 4 shows an exploded perspective view of a faceplate assembly and a right inner arm of a load handler.
Figure 5:
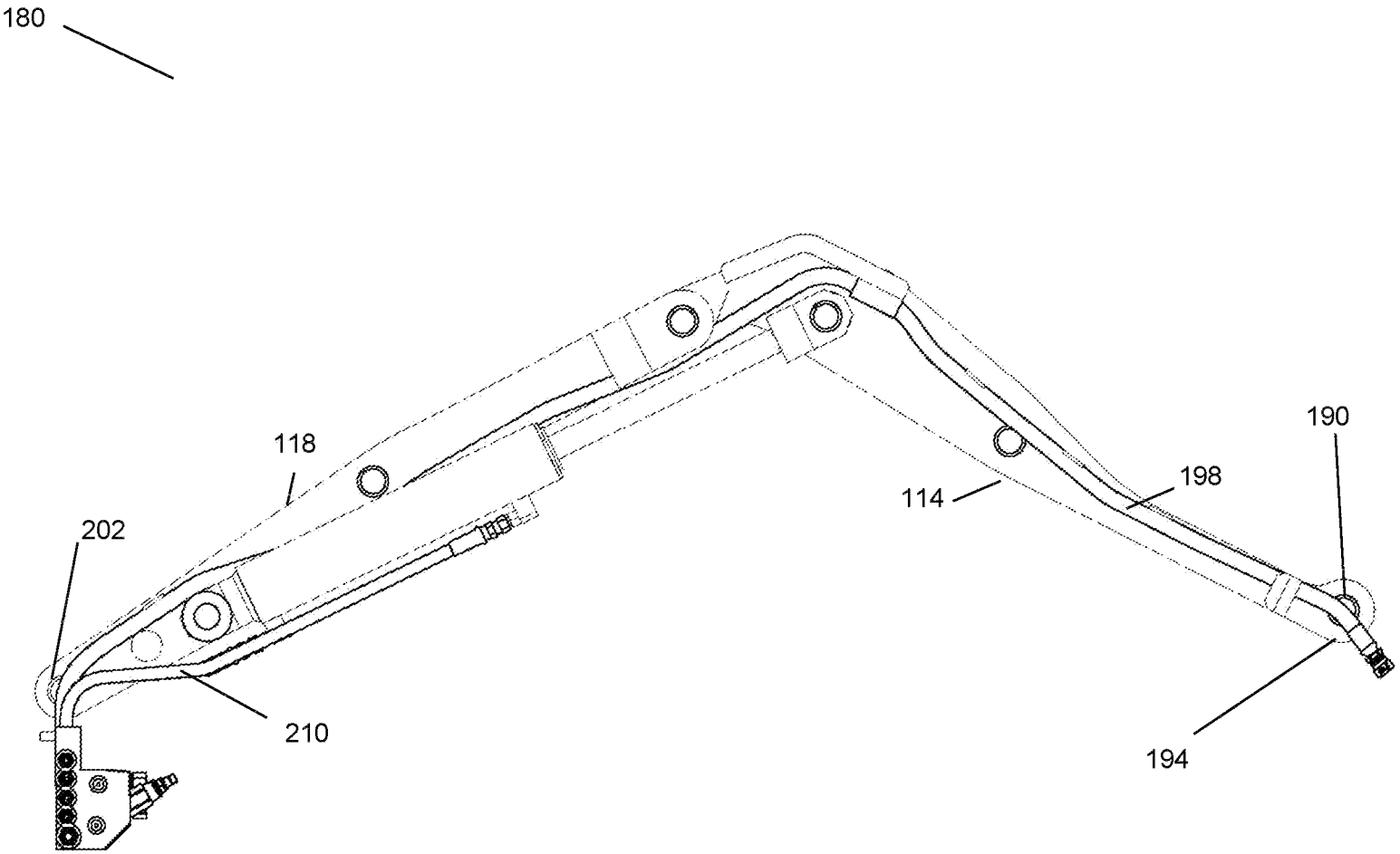
FIG. 5 shows a side view of a right inner arm of a load handler.

FIGS. 2 through 8B show various views of a first representative embodiment of a load handler 100. The load handler 100 comprises a faceplate assembly 102 attached to a pantograph mechanism 104, which in turn is attached to a frame assembly 150. The load handler 100 is configured to be mounted on a lift truck 10 (see FIG. 1) and configured to handle cargo set on a slipsheet while providing a view for a lift truck operator through a center of the handler 100 that is unobstructed by the handler 100. The handler 100 has an unobstructed view window 256 extending through the handler 100 when the handler 100 is in any normal operating configuration. That is, the view window 256 is not obstructed by parts of the handler 100, regardless of whether the handler 100 is in a fully extended configuration, in a fully retracted configuration, or any configuration in between (See FIGS. 2 and 8B). The view window 256 is not considered obstructed by trivial objects that do not significantly interfere with a lift truck operator's view through the view window 256, such as a wire or a string or other thin objects that are not capable of bearing significant compressive loads. Nor is the view window 256 considered obstructed by transparent objects that that do not significantly distort or otherwise interfere with a lift truck operator's view through the view window 256.

The view window 256 through the handler 100 has a cross-section orthogonal to a longitudinal center line 254 of the handler 100, extending laterally for a width of at least ⅛ of the width of the handler 100, and a height of at least ⅓ of the height of the handler 100. In the first representative embodiment, the width of the handler 100 is 40 inches, matching the width of a standard pallet, the height is 40 inches, the width of the cross-section of the view window 256 is 10 inches and the height of the cross-section of the view window 256 is 20 inches. In other embodiments the width of the cross-section of the view window 256 may be as little as 5 inches and the height as little as 13⅓ inches, which is sufficient for a useful view window 256. In the first representative embodiment, the unobstructed handler view window 256 is rectangular in cross-section, but in other embodiments may be oval. In the first representative embodiment, view window 256 extends through the handler 100 along a longitudinal center line 254 of the handler 100, with the handler longitudinal center line 254 defined by the intersection of a handler horizontal center plane 250 and a handler vertical center plane 252. Though the longitudinal center line 254 passes through the view window 256, the view window 256 is not necessarily centered on the longitudinal center line 254. In other embodiments, the view window 256 may be shifted and/or smaller, such that the handler vertical center plane 252 passes through the view window 256, but the handler horizontal center plane 250 does not.

The faceplate assembly 102 in the first representative embodiment 100 has a faceplate 130 with a faceplate center opening 146 that is at least as large as the handler view window 256. The faceplate assembly 102 has a left gripper actuator 138 and a right gripper actuator 140 attached to the faceplate 130 and flanking the faceplate center opening 146. The faceplate assembly 102 has a gripper jaw 132 attached to a lower portion of the faceplate 130. The faceplate assembly 102 has a gripper bar 134 that is slidingly coupled to the faceplate 130 and coupled to the left gripper actuator 138 and right gripper actuator 140. The left gripper actuator 138 and right gripper actuator 140 are configured to move the gripper bar 134 between an up position and a down position in contact with the gripper jaw 132.

The pantograph mechanism 104 comprises two inner arms 178, 180 and two outer arms 174, 176. The inner arms include a left inner arm 178 and a right inner arm 180. The outer arms 174, 176 include a left outer arm 174 and a right outer arm 176. The inner arms 178, 180 are attached with a pivoting attachment to the faceplate assembly 102 and with a pivoting attachment to the frame assembly 150. The outer arms 174, 176 are attached with sliding attachments (channel posts 228) to the faceplate assembly 102 and with sliding attachments to the frame assembly 150. The left inner arm 178 comprises a left inner primary arm 106 and a left inner secondary arm 110 that are pivotally coupled by a left inner arm center pivot pin 182. Likewise, the right inner arm 180 comprises a right inner primary arm 114 and a right inner secondary arm 118 that are pivotally coupled by a right inner arm center pivot pin 184. The left outer arm 174 comprises a left outer primary arm 108 and a left outer secondary arm 112 that are pivotally coupled. Likewise, the right outer arm 176 comprises a right outer primary arm 116 and a right outer secondary arm 120 that are pivotally coupled.

In the first representative embodiment handler 100, the left inner arm 178 and the right inner arm 180 are only coupled by structures that are within a distance from one of the distal ends of the inner arms that is no more than one quarter of a length of one of the inner arms 178,180. This ensures that cross-bracing between the inner arms 178, 180 does not obscure the view window 256. In other embodiments, the left inner arm 178 and the right inner arm 180 are only coupled by structures that are within a distance from one of the distal ends of the inner arms that is no more than one third of a length of one of the inner arms 178,180. This results in a smaller view window than in the first representative embodiment but is better than having a cross bar between the inner arms at or near the middle of the inner arms 178, 180. In the first representative embodiment handler 100, other than indirectly connecting at the faceplate assembly 102 and the frame assembly 150, the left inner arm 178 and the right inner arm 180 are connected only at an inner arm cross bar 126. The inner arm cross bar 126 is connected to the inner arms 178, 180 such that the inner arm cross bar 126 is below the handler horizontal center plane 250 regardless of the configuration of the handler, even when the handler 100 is in a fully retracted configuration. In the first representative embodiment, inner arm cross bar 126 is no higher than a top hook bar 258 of a top hook assembly 170 when the handler 100 is in any normal operating configuration. This configuration of the inner arm cross bar 126 provides for maintaining the handler view window 256 unobstructed regardless of whether the handler 100 is fully extended or fully retracted or in any other normal operating configuration.

The pantograph mechanism 104 includes two pieces of cross bar webbing 186, one between the inner arms 178, 180 and the inner arm cross bar 126, extending towards the inner arm center pivot pins 182, 184. The cross-bar webbing 186 provides stiffness to resist lateral movement of the inner arms 178, 180, especially rotational movement or vibration about the inner arm cross bar 126, eliminating the need for additional cross bracing between the inner arms 178, 180 nearer the inner arm center pivot pins 182, 184. In the first representative embodiment, there are no cross-bracing members between the two inner arms 178, 180, other than the faceplate assembly 102, the frame assembly 150, and the inner arm cross bar 126. Likewise, there is no cross-bracing members between the two outer arms 174, 176, other than the faceplate assembly 102, the frame assembly 150, and the inner arm cross bar 126 through the inner arms 178, 180. Elimination of cross bracing at the ends and jointed middles of the arms 174, 176, 178, 180 allows a larger unobstructed view through the load handler 100 for a lift truck operator.

The pantograph mechanism 104 is configured so that when the handler 100 is in the fully retracted configuration, the gripper actuators 138, 140 nest within void spaces of the inner arms 178, 180. This allows the faceplate assembly 102 to be pulled in closer to the frame assembly 150 when the handler 100 is in a fully retracted configuration.

The left inner primary arm 106 has a left inner primary arm pivot bushing 192 that pivotally couples the left inner primary arm 106 to the frame assembly 150 with a left inner primary arm pivot pin 188. Likewise, the right inner primary arm 114 has a right inner primary arm pivot bushing 194 that pivotally couples the right inner primary arm 114 to the frame assembly 150 with a right inner primary arm pivot pin 190. The right inner primary arm pivot bushing 194 extends laterally outward to the right from the right inner primary arm 114, leaving space for a right arm hydraulic line 198 to pass to the left of the right inner primary arm pivot pin 190 through or near a longitudinal center line of the right inner primary arm pivot pin 190 (See FIG. 5), at least near enough so that at least a portion of the right arm hydraulic line 198 passes through a cylindrical volume around the longitudinal center line of the right inner primary arm pivot pin 190, with this right primary pivot pin cylindrical volume having a radius that is the same as that of the right inner primary arm pivot pin 190. As a result, little slack in the right arm hydraulic line 198 needs to be provided around the right inner primary arm pivot pin 190. Avoiding slack makes for more streamlined running of hydraulic lines with less potential for interfering with the view of the lift truck operator. Similarly, the left inner primary arm pivot bushing 192 extends laterally outward to the left from the left inner primary arm 106 and has a similar effect on a left arm hydraulic line (not shown), where the left arm hydraulic line passes through or near a longitudinal center line of the right inner primary arm pivot pin 190, (See FIG. 5) at least near enough so that at least a portion of the left arm hydraulic line passes through a cylindrical volume around a longitudinal center line of the left inner primary arm pivot pin 188, with this left primary pivot pin cylindrical volume having a radius that is the same as that of the left inner primary arm pivot pin 188.

The right inner secondary arm 118 pivotally couples to a right inner secondary arm pivot bracket 206 of the faceplate assembly 102 with two right inner secondary arm pivot pins 202. A right inner secondary arm pivot gap 214 is left between the right inner secondary arm pivot pins 202. This right inner secondary arm pivot gap 214 allows the right arm hydraulic line 198 and two right inner arm actuator hydraulic lines 210 to pass through or near a longitudinal center line of the right inner secondary arm pivot pins 202, (See FIG. 5) at least near enough so that at least a portion of the right arm hydraulic line 198 and the two right inner arm actuator hydraulic lines 210 pass through a cylindrical volume around the longitudinal center line of the right inner secondary arm pivot pin 202*s*, with this right secondary pivot pin cylindrical volume having a radius that is the same as that of the right inner secondary arm pivot pins 202. As a result, little slack in the right arm hydraulic line 198 or the right inner arm actuator hydraulic lines 210 needs to be provided around the right inner secondary arm pivot pins 202. The left inner secondary arm 110 is pivotally coupled to a left inner secondary arm pivot bracket 204 of the faceplate assembly 102 in a similar manner so that the left arm hydraulic line and two left inner arm actuator hydraulic lines pass through or near a longitudinal center line of the left inner secondary arm pivot pins, at least near enough so that at least a portion of the left arm hydraulic line passes through a cylindrical volume around a longitudinal center line of the left inner secondary arm pivot pins, with this right secondary pivot pin cylindrical volume having a radius that is the same as that of the right inner secondary arm pivot pin.

In the first representative embodiment, a right inner arm center pivot pin 184 pivotingly couples the right inner primary arm 114 to the right inner secondary arm 118. In other embodiments, two right inner arm center pivot pins couple the right inner primary arm 114 to the right inner secondary arm 118 with a gap between the two right inner arm center pivot pins that allows the right arm hydraulic line 198 to pass through or near a longitudinal center line of the two right inner arm center pivot pins, at least near enough wherein at least a portion of the right arm hydraulic line 198 passes through a cylindrical volume around a longitudinal center line of the two right inner arm center pivot pins, the right primary pivot pin cylindrical volume having a radius that is the same as that of the two right inner arm center pivot pins. Likewise, in the first representative embodiment, a left inner arm center pivot pin 182 pivotingly couples the left inner primary arm 106 to the left inner secondary arm 110. In other embodiments, two left inner arm center pivot pins couple the left inner primary arm 106 to the left inner secondary arm 110. With a gap between the two left inner arm center pivot pins that allows the left arm hydraulic line to pass through or near a longitudinal center line of the two left inner arm center pivot pins, at least near enough wherein at least a portion of the left arm hydraulic line passes through a cylindrical volume around a longitudinal center line of the two left inner arm center pivot pins, the left primary pivot pin cylindrical volume having a radius that is the same as that of the two left inner arm center pivot pins.

The load handler 100 has a streamlined hydraulic system that aids in keeping the view through the center of the handler 100 clear and unobstructed. Only two lines are needed to run between the frame assembly 150 and the faceplate assembly 102 a right arm hydraulic line 198 coupled to the right inner arm 180, and a left arm hydraulic line (not shown) coupled to the left inner arm 178. The faceplate assembly 102 has a faceplate manifold 144 mounted on the faceplate 130 below the faceplate center opening 146. In a top back side of the gripper jaw 132 there is a griper jaw manifold hole 142 that allows the faceplate manifold 144 to protrude through the gripper jaw 132. The hydraulic lines enter the faceplate manifold 144 from the side, between the faceplate 130 and the gripper jaw 132. In addition to ports for the left arm hydraulic line and right arm hydraulic line 198, the faceplate manifold 144 has ports for 8 hydraulic lines to operate 4 actuators—a left inner arm actuator 122 and a right inner arm actuator 124 as well as the left gripper actuator 138 and the right gripper actuator 140. All four actuators operate in unison, with the faceplate manifold 144 coordinating their movements. The left gripper actuator 138 and right gripper actuator 140 are configured to pull up the gripper bar 134 when the left inner arm actuator 122 and right inner arm actuator 124 are extending and configured to push down the gripper bar 134 when the left inner arm actuator 122 and right inner arm actuator 124 are retracting. In some embodiments, the faceplate manifold 144 causes the gripper actuators 138, 140 complete movement of the gripper bar 134 before the inner arm actuators 122, 124 begin movement of the pantograph mechanism 104. While the inner arm actuators 122, 124 are moving the pantograph mechanism 104, the gripper actuators 138, 140 maintain the position of the gripper bar 134. Sequence valves may be used to coordinate raising and lower of the gripper bar 134 with extension and retraction of the pantograph mechanism 104. No valves are necessary in the faceplate manifold 144 or anywhere on the faceplate assembly 102 to change the direction of hydraulic fluid flow to the inner arm actuators 122, 124 and gripper actuators 138 and 140. A single four port, three position valve on the lift truck 10 is used to control the load handler 100.

The faceplate manifold 144 is positioned on the faceplate 130 such that when the load handler 100 is in a fully retracted configuration, a portion of the faceplate manifold 144 extends above and rearward of the frame beam 242 (See FIG. 8A), allowing the faceplate 130 to more fully retract against the frame assembly 150. In the first representative embodiment, the frame beam 242 has a frame beam pocket 244 carved out on its front side configured to accommodate the faceplate manifold 144. When the load handler 100 is in a fully retracted configuration, a portion of the faceplate manifold 144 extends into the frame beam pocket 244 when the handler 100. This arrangement allows the faceplate manifold 144 to be positioned lower in the faceplate 130, rather than high enough to miss the frame beam 242 completely. This in turn allows the faceplate center opening 146 to extend lower in the faceplate 130 as well, increasing the view window through the load handler 100. In other embodiments, the frame beam 242 does not have a frame beam pocket 244.

A left faceplate channel 220 and a right faceplate channel 222 are included in the faceplate assembly 102 and attached to the faceplate 130 to the left and right of the faceplate center opening 146, respectively. Typically, the left faceplate channel 220 and the right faceplate channel 222 are positioned laterally further outboard from the left gripper actuator 138 and right gripper actuator 140. The faceplate channels 220, 222 serve several functions. First, they act as T-slot guides for the faceplate channel posts 228. The faceplate channels 220, 222 have similar T-slot structure and function as the frame towers 230, 232. Second, they act as guides for the gripper bar posts 216, 218. The faceplate channel posts 228 slide within the faceplate channels 220, 222 as the load handler 100 changes between the full extended and the fully retracted configurations. In some embodiments, the faceplate channels 220, 222 serve a third function—they act as surfaces for contacting a load on the handler 100. Not only does the faceplate 130 have a large faceplate center opening 146 for increasing visibility for the lift truck 10 operator, but also has one or more faceplate side openings 272. While it is desirable for these faceplate side openings to be as large as possible for visibility purposes, their size may be limited by a need for some structure on the front of faceplate 130 to contact the load when the load handler 100 is extending and the faceplate 130 is pushing the load off the platens 274. In some embodiments, the faceplate channels 220, 222 provide contact surface for pushing a load when the handler 100 is extending, allowing more and/or larger faceplate side openings 272. The faceplate channels 220, 222 performing these functions not only save materials and weight, but also allow the components attached to the faceplate 130 to be arranged in a more compact way laterally than otherwise, which in turn facilitates the faceplate center opening 146 being wider than it otherwise could be.

Each of the faceplate channels 220, 222, has a faceplate channel opening 224 to allow insertion and removal of the faceplate channel posts 228 during maintenance operations. The faceplate channel openings 224 are located low enough so that the faceplate channel posts 228 do not reach them during normal operations, even when the load handler 100 is in the fully extended configuration.

Figure 6:
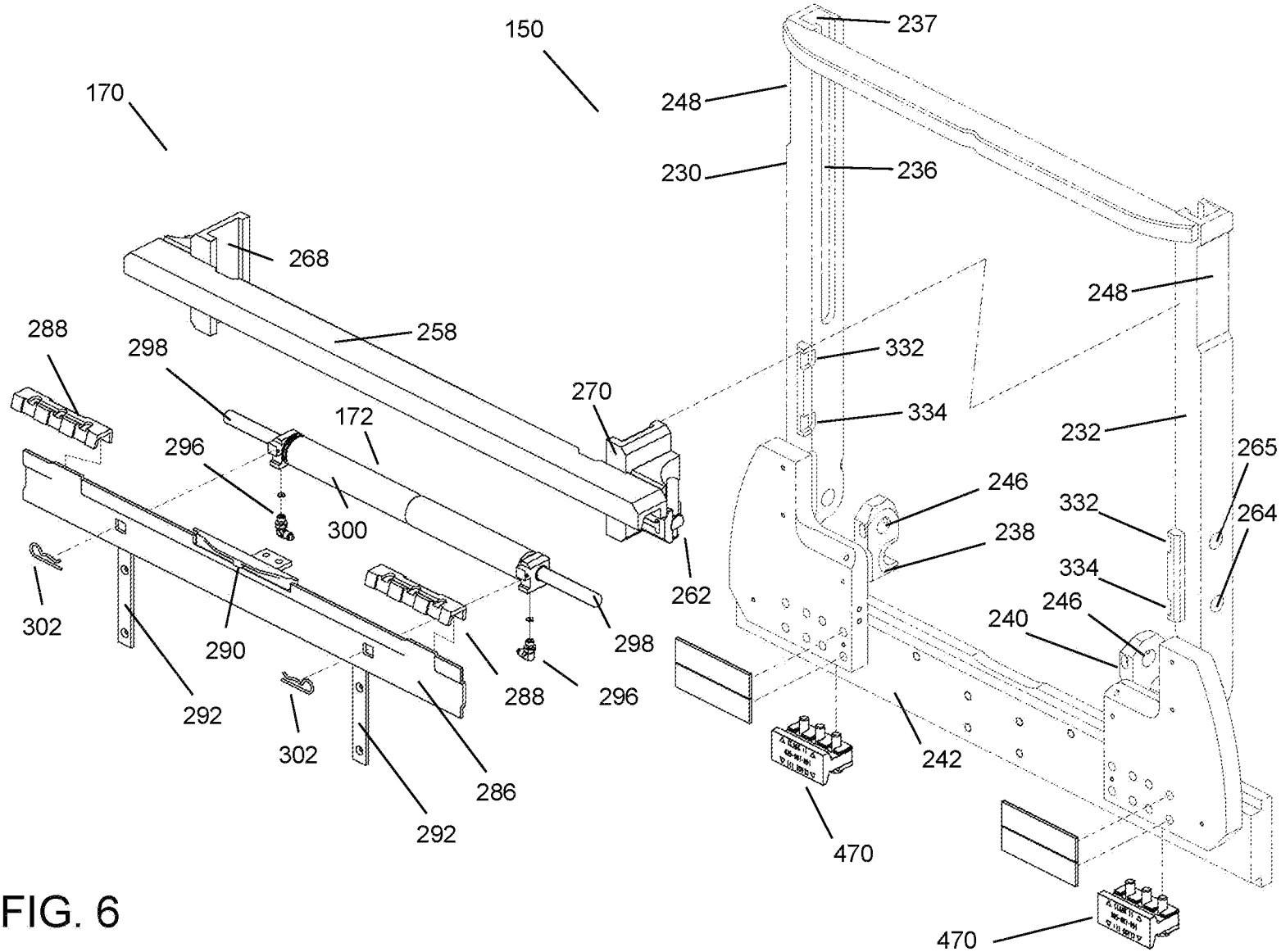
FIG. 6 shows an exploded perspective view of a frame assembly, a top hook assembly and associated components.

As shown in FIG. 6, the frame assembly 150 comprises a frame beam 242, a left frame tower 230, a right frame tower 232, a left frame arm bracket 238, and a right frame arm bracket 240. The left frame tower 230 and the right frame tower 232 are attached to the front side of the frame beam 242. The frame towers 230, 232 perform multiple functions.

One function of the frame towers 230, 232 is guiding the outer arms 174, 176. Each of the frame towers 230, 232, have a channel with a channel slot 236 and channel cavity 237. The channel slots 236 are T-shaped for guiding the channel posts 228 within the frame tower channel slots 236 as the pantograph mechanism 104 extends and retracts. The frame tower channel slots 236 are open on top for easy removal of the channel post 228 in maintenance, but the channel posts 228 do not pass the top of the frame tower channel slots 236 during normal operations, even when the pantograph mechanism 104 is fully retracted. The channel post 228 is encapsulated with t-slot bearings 260. The t-slot bearings 260 facilitate sliding within the channel cavity 237 and give lateral support to the channel post 228, preventing lateral movement. The channel posts 228 have post wings that are wider than the channel slot 236 to prevent the channel post 228 from exiting the slot if the t-slot bearings 260 wear out or are destroyed.

Another function of the frame towers 230, 232 is supporting the inner arms 178, 180. The frame towers 230, 232 have inner arm pivot pin holes 246, which, together with inner arm pivot pin holes 246 in the frame arm brackets 238, 240, accept the inner primary arm pivot pins 188, 190. The inner primary arm pivot bushings 192, 194 of the inner primary arms 106, 114 slidingly fit in the gap between the frame towers 230, 232 and the frame arm brackets 238, 240. The frame arm brackets 238, 240 also hold a platen positioner 154 (see FIG. 7). In some embodiments, inner primary arm pivot pins, 188, 190 are not coupled with the frame arm brackets 238, 240, but only with the frame towers 230, 232.

Yet another function of the frame towers 230, 232 is supporting the top hook assembly 170. The top hook assembly 170 is configured for transferring load forces to the lift truck 10. In the first representative embodiment handler 100, the top hook assembly 170 comprises the top hook bar 258, a left top hook bracket 268, a right top hook bracket 270. Both the left and right top hook brackets 268, 270 have a top hook pin 262. The frame towers 230, 232 have frame tower indentations 248 that allow the top hook assembly 170 to be placed on the frame towers 230, 232 and then slid down and secured into position. The first representative embodiment 100 has a securing mechanism for securing without tools the top hook assembly 170 in a first position that configures the handler for mounting to an ITA (Industrial Truck Association) class 2 lift truck carriage or a second position that configures the handler for mounting to an ITA class 3 lift truck carriage. In the first representative embodiment handler 100, the frame towers 230, 232 are configured with two sets of pin holes 264, 265 for securing the top hook assembly 170 to the frame towers 230, 232 with top hook pins 262 in two different positions—one position for mounting to an ITA class 2 lift truck carriage and one position for mounting to an ITA class 3 lift truck carriage. In other embodiments, the two sets of pin holes 264, 265 are configured for securing the top hook assembly 170 to the frame towers 230, 232 in a first position for mounting to an ITA class 3 lift truck carriage and a second position for mounting to an ITA class 4 lift truck carriage. ITA class 2 specifies a 16" carriage height, ITA class 3 specifies a 20" carriage height and ITA class 4 specifies a 25" carriage height. This allows for toolless mounting of the top hook assembly 170 to the frame towers 230, 232 and toolless transition between the class 2, and class 3 positions. In other embodiments, some other mechanism may be used for securing the top hook assembly 170 to the frame towers, 230, 232, such as notches and ratcheting latches.

Associated with the top hook assembly 170, the first representative embodiment 100 has slide bearings 288, a cylinder anchor 286 and a side shift actuator 172. The cylinder 300 of the side shift actuator 172 is attached to the cylinder anchor 286 with side shift lock pins 302. The cylinder anchor 286 and has one or more a cylinder anchor tabs 290 configured to nest in indentations in the upper carriage bar 16 and hold the cylinder anchor 286 in place relative to the carriage 14 and transfer the force of the side shift actuator 172. The slide bearings 288 are positioned over the cylinder anchor 286 and the carriage 14. The side shift actuator 172 has actuator rods 298 that fit into upper shifter detents 332 or lower shifter detents 334. However, in other embodiments, the side shift actuator 172 is omitted, in which case the engagement between the top hook assembly 170 and the carriage 14 is not a sliding one.

Load is transferred from the platens 274 to the frame beam 242 to the frame towers 230, 232 through the left and right top hook brackets 268, 270 to the top hook bar 258, then through the slide bearings 288 to the upper carriage bar 16 of the lift truck 10. The frame towers 230, 232 are the only vertical structural support between the top hook bar 258 and the lower parts of the frame assembly 150, such as the frame beam 242 and the frame arm brackets 238, 240. Thus, all vertical loads transferred from the frame assembly 150 to the carriage 14 of the lift truck 10 are transferred through the frame towers 230, 232.

Since the frame arm brackets 238, 240 and the frame towers 230, 232 perform multiple functions, they and the other components of the frame assembly 150 and components attached thereto can be arranged more compactly, allowing for a larger unobstructed viewing window 256 through the frame assembly 150 than would be possible otherwise.

Figure 7:
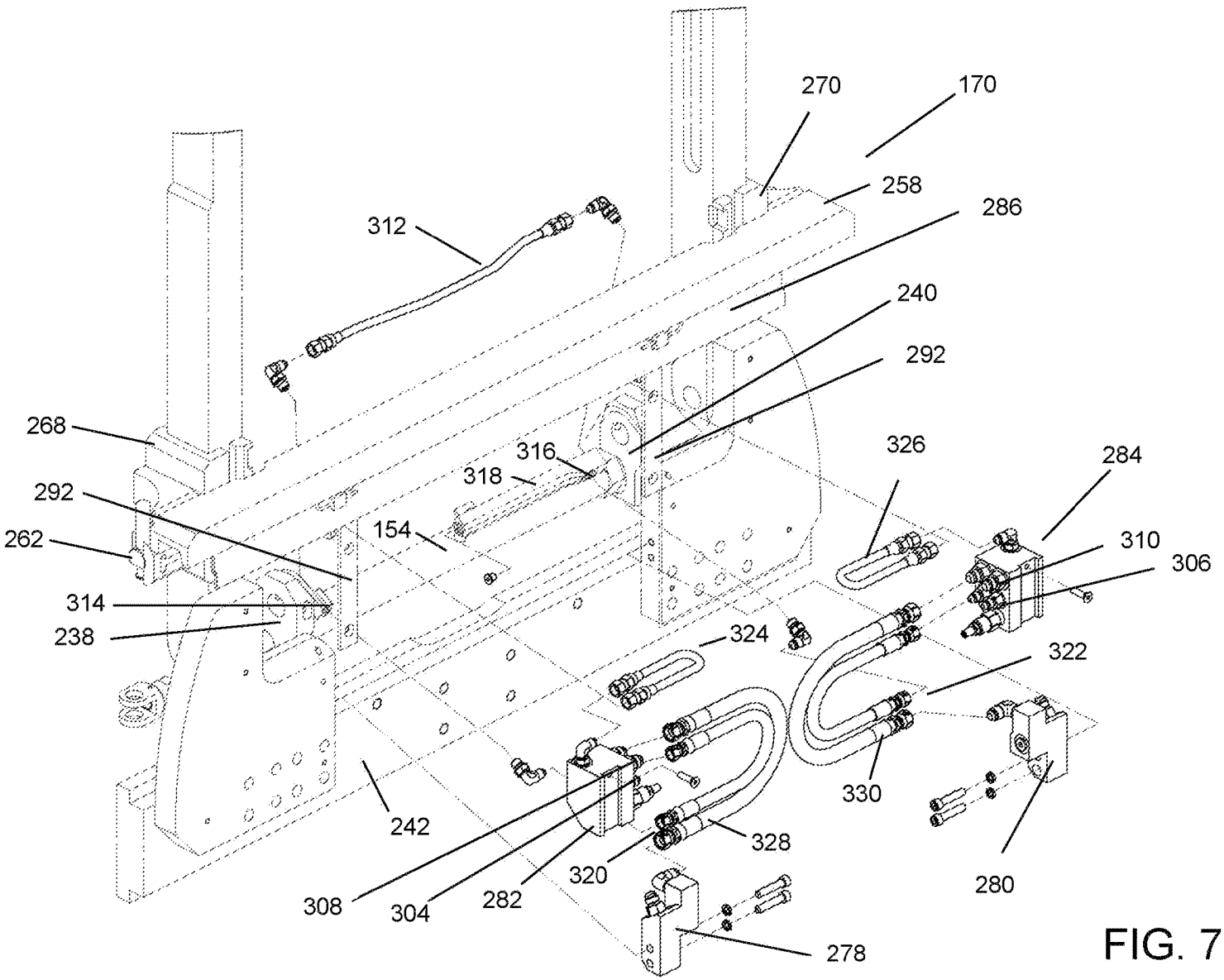
FIG. 7 shows an exploded perspective view of hydraulic components associated with the frame assembly.
Figure 8B:
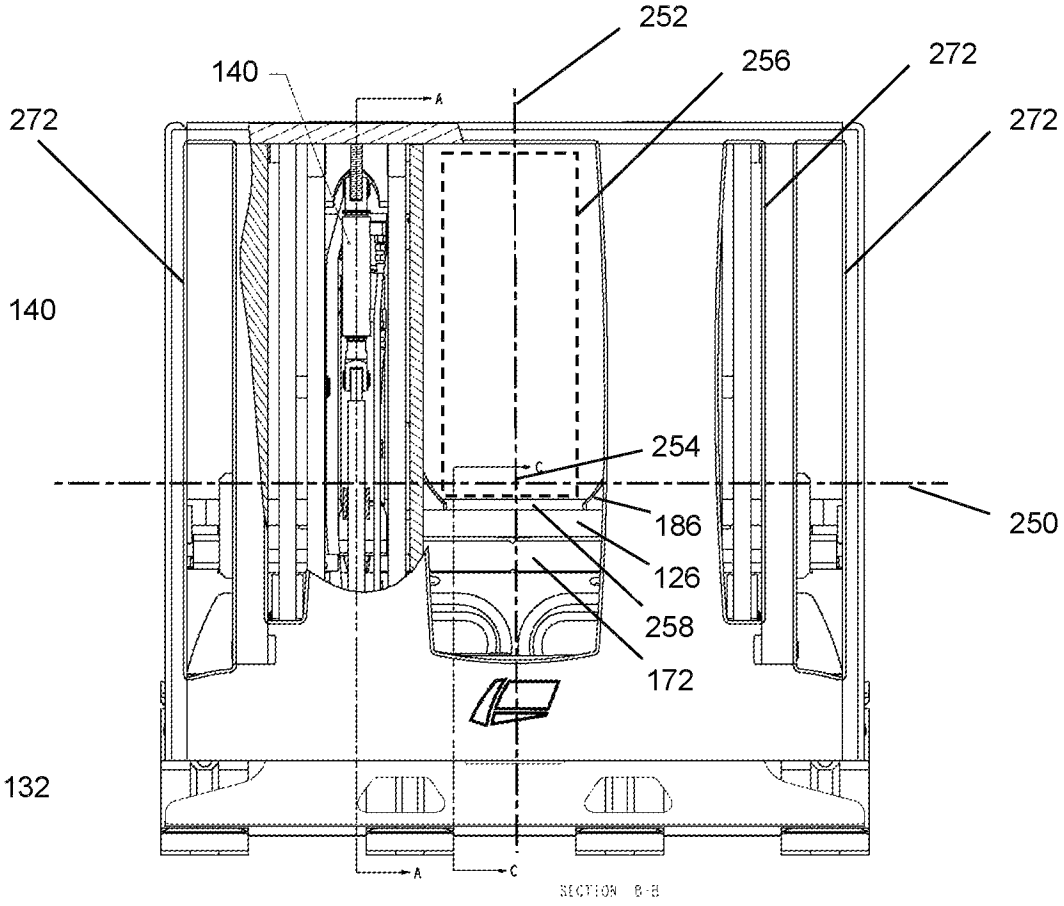
FIG. 8B shows a front cut-away view of a load handler in a fully retracted configuration.
Figure 8A:
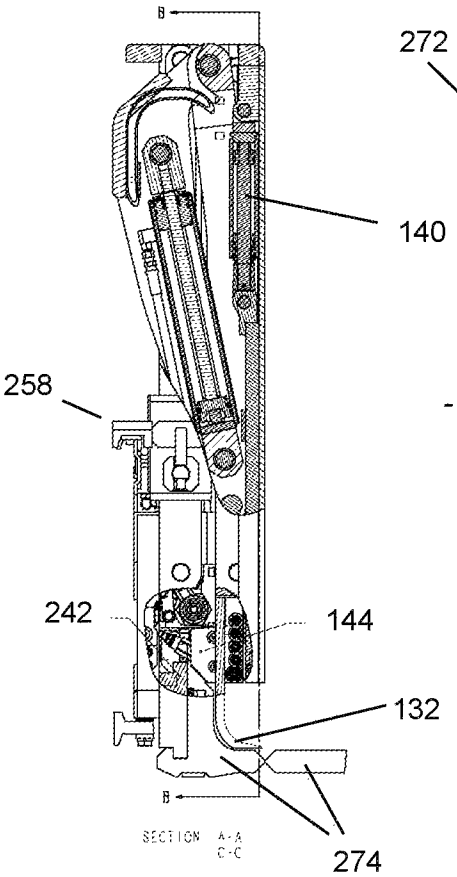
FIG. 8A shows a side cut-away view of a load handler in a fully retracted configuration.

FIG. 7 shows an exploded perspective view of hydraulic components associated with the frame assembly. The platen positioner 154 is held by the left frame arm bracket 238 and the right frame arm bracket 240. The platen positioner 154 has a left positioner hydraulic port 314, a right positioner hydraulic port 316, a positioner cross connect line 312 and a positioner center hydraulic connection 318. The platen positioner 154 has two pistons and two rods. The positioner center hydraulic connection 318 connects the right positioner hydraulic port 316 to the center of the platen positioner 154 so that hydraulic fluid flowing through the right positioner hydraulic port 316 flows to/from the center of the platen positioner 154. The positioner cross connect line 312 connects the left positioner hydraulic port 314 with the right end of the platen positioner 154 so that hydraulic fluid flowing through the left positioner hydraulic port 314 flows to/from both left and right ends of the platen positioner 154.

A left anchor manifold 282 and a right anchor manifold 284 are attached to cylinder anchor stems 292 that project down from the cylinder anchor 286. A left beam manifold 278 and a right beam manifold 280 are coupled to the frame beam 242. The left anchor manifold 282 has a left push-pull manifold feed port 308 and a left shifter manifold feed port 304 configured to accept hydraulic hose lines from the lift truck. Likewise, the right anchor manifold 284 has a right push-pull manifold feed port 310 and a right shifter manifold feed port 306 configured to accept hydraulic hose lines from the lift truck. A left shifter hydraulic line 324 couples the left anchor manifold 282 to a side shift hydraulic fitting 296 on the left side of the side shift actuator 172 and a right shifter hydraulic line 326 couples the right anchor manifold 284 to a side shift hydraulic fitting 296 on the right side of the side shift actuator 172. A left positioner hydraulic line 320 couples the left anchor manifold 282 to the left positioner hydraulic port 314 and a right positioner hydraulic line 322 couples the right anchor manifold 284 to the right positioner hydraulic port 316. The left anchor manifold 282 and right anchor manifold 284 have sequence valves to coordinate the actions of the platen positioner 154 and the side shift actuator 172. The sequence valves are further configured to operate the side shift actuator 172 first until it reaches its left or right limit, then direct flow to the platen positioner 154. The sequence valves are configured to cause the platen positioner 154 to move the platens towards each other when the side shift actuator 172 is at its right limit and configured to move the platens away from each other when the side shift actuator 172 is at its left limit. A left push-pull hydraulic transfer line 328 couples the left anchor manifold 282 to the left beam manifold 278 which couples to the left arm hydraulic line 196. A right push-pull hydraulic transfer line 330 couples the right anchor manifold 284 to the right beam manifold 280 which couples to the right arm hydraulic line 198. These hydraulic lines 324, 326, 320, 322, 328, 330, have sufficient slack so the top hook assembly 170 can be moved between the first set of top hook pin holes 264 for ITA class 2 and the second set of top hook pin holes 265 for ITA class 3 without disconnecting any of these hydraulic lines and have sufficient slack as the frame assembly 150 (along with the platen positioner 154 and the beam manifolds 278, 280) moves under the operation of the side shift actuator 172 relative to the cylinder anchor 286 (along with the anchor manifolds 282, 284).

In some alternative embodiments, a top bar of the faceplate 130 over the faceplate center opening 146 and the frame cross bar 234 are not included. This is possible due to the robust construction of the frame beam 242, the other parts of the faceplate 130, the frame towers 230, 232 and the faceplate channels 220, 222 allowing for an even more unobstructed view for the lift truck operator.

The load handler 100 has one or more platens 274 coupled to the frame beam 242. The handler 100 is configured to allow the platens 274 to be mounted from the side on a single structural member, the frame beam 242. The one or more platens 274 each have a wear plate 276 that extends the full width of the platen 274. The platen wear plates 276 are comprised of manganol or some other suitable high hardness material. The wear plates 276 protect the one or more platens 274 from excessive wear and frequent replacement from being dragged across floors, pavement and other hard surfaces.

Second Representative Embodiment

Figure 9A:
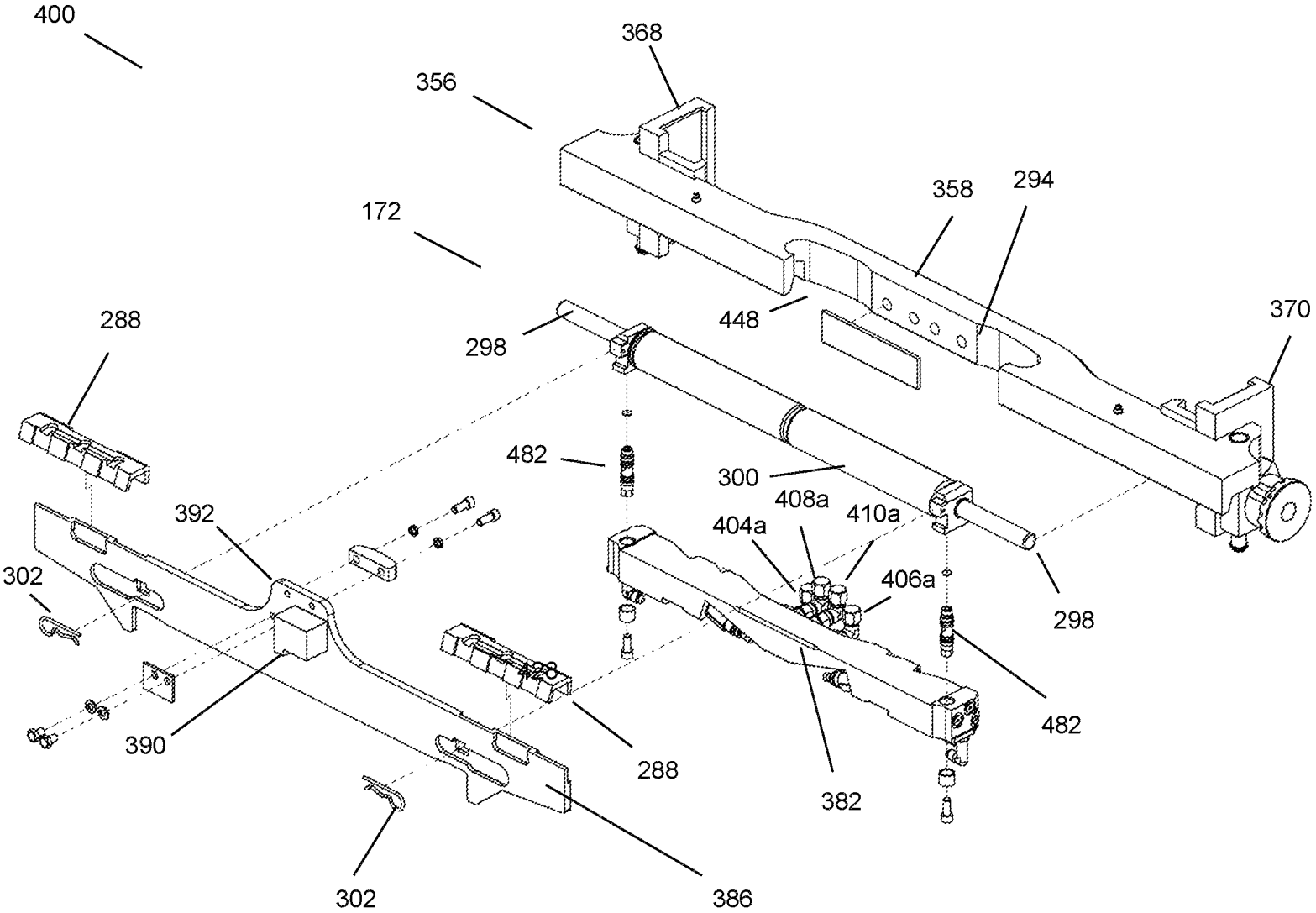
FIG. 9A shows an exploded perspective view of portions of a second representative embodiment of a second embodiment load handler.
Figure 9B:
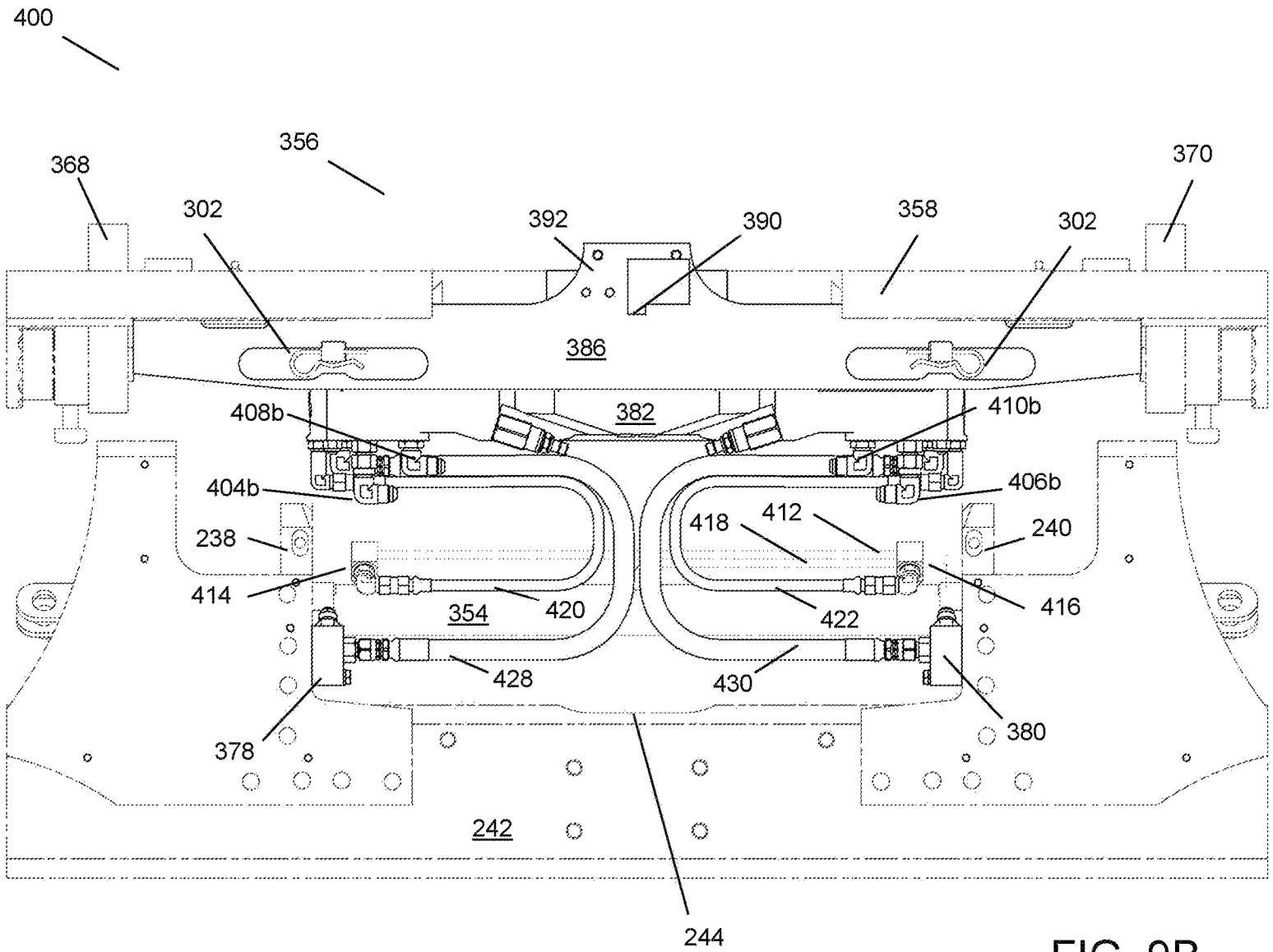
FIG. 9B shows a rear view of portions of a second representative embodiment of a second embodiment load handler.

FIG. 9B shows a rear view of portions of a second representative embodiment of a second embodiment load handler 400. The second embodiment handler 400 has the same features as the first embodiment load handler 100 except as shown and described herein. One difference is a center manifold 382 replaces the left anchor manifold 282 and right anchor manifold 284. The center manifold 382 is coupled to the underside of side shift actuator 172 for mechanical support and is hydraulically connected directly into the left and right ends of the side shift actuator 172, eliminating the left shifter hydraulic line 324 and right shifter hydraulic line 326. In the second embodiment 440, the center manifold 382 is coupled mechanically and hydraulically to the side shift actuator 172 by threaded fittings 482.

Figures 10A, 10B:
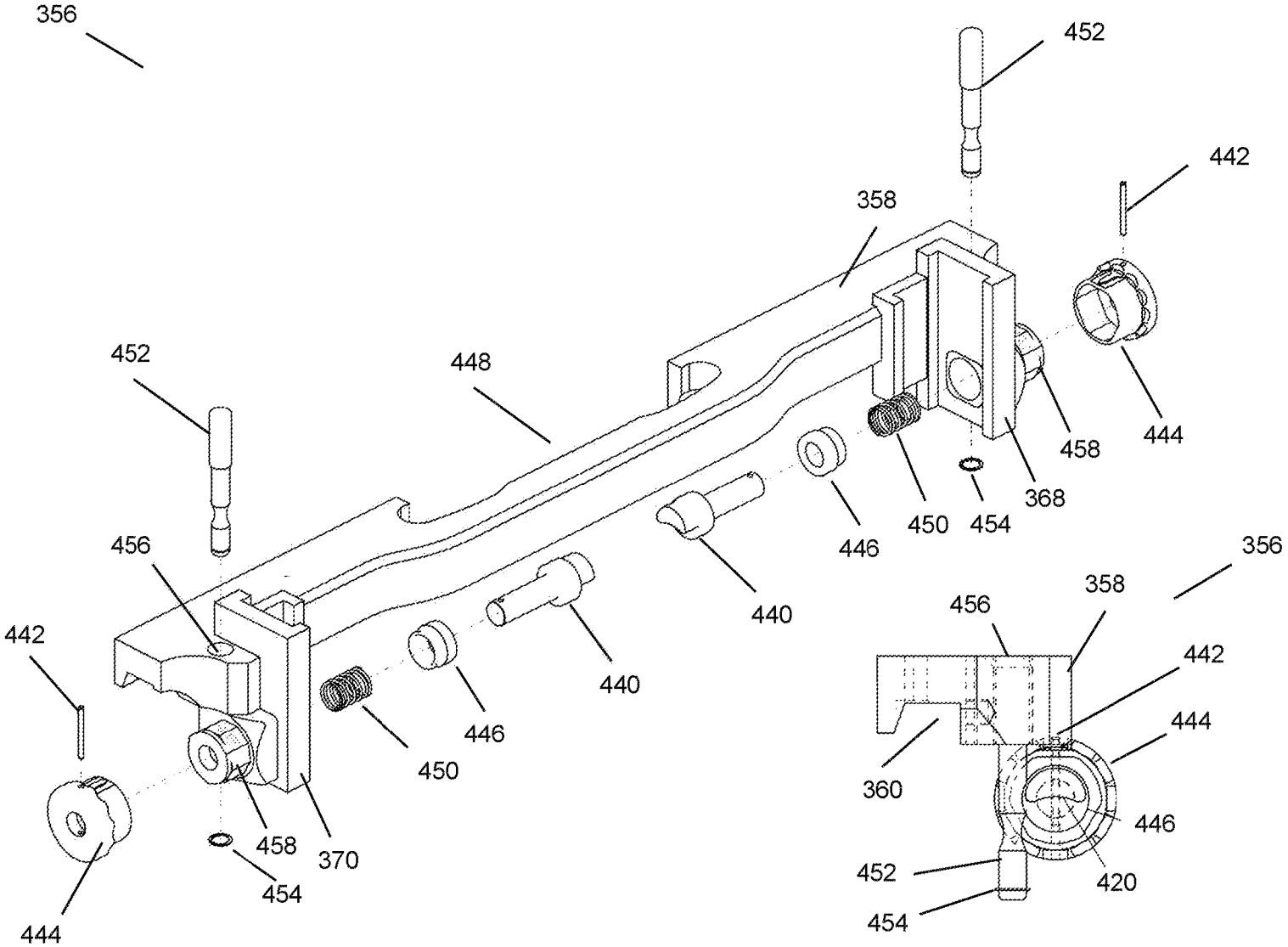
FIG. 10A shows an exploded perspective view of the second embodiment top hook assembly.
FIG. 10B shows a side view of the second embodiment top hook assembly.
Figure 11:
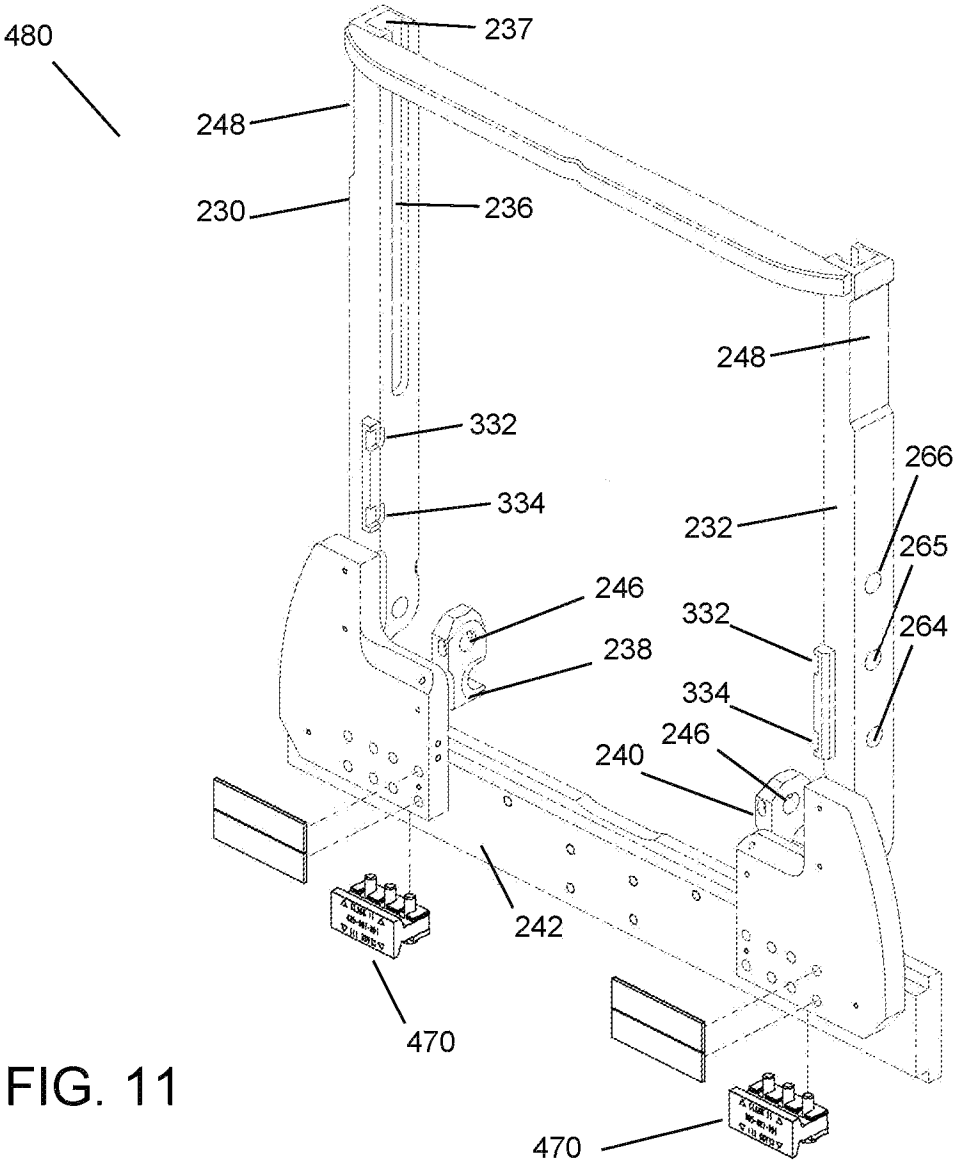
FIG. 11 shows an exploded perspective view of a second embodiment frame assembly.

As shown in FIGS. 10A, 10B, and 11, another difference is that the second embodiment handler 400 has a top hook assembly 356 and a frame assembly 480 that have an improved mechanism for attaching the top hook assembly 356 to the frame assembly 480. The top hook assembly 356 is configured for mounting on the frame assembly 480 in a first position that configures the handler for mounting to an ITA (Industrial Truck Association) class 2 lift truck carriage, in a second position that configures the handler for mounting to an ITA class 3 lift truck carriage or in an unlocked position. In the second embodiment handler 400, the frame towers 230, 232 are configured with three sets of pin holes 264, 265, and 266 for securing the top hook assembly 170 to the frame towers 230, 232 in three different positions—one position in a first set of top hook pin holes 264 for mounting to an ITA class 2 lift truck carriage, a second position in a second set of top hook pin holes 265 for mounting to an ITA class 3 lift truck carriage, and a third position (unlocked position) in a third set of top hook pin holes 266 for installation and removal of the push-pull handler 400.

As shown in FIG. 9A, the center manifold 382 has a left push-pull manifold feed port 408*a*, a right push-pull manifold feed port 410*a*, a left shifter manifold feed port 404*a*, and a right shifter manifold feed port 406*a*, positioned on the front of the center manifold 382 (collectively "the front feed ports"). As shown in FIG. 9B, the center manifold 382 has a left push-pull manifold feed port 408*b*, a right push-pull manifold feed port 410*b*, a left shifter manifold feed port 404*b*, and a right shifter manifold feed port 406*b*, positioned on the bottom of the center manifold 382 (collectively "the bottom feed ports"). The front and bottom feed ports are configured to accept hydraulic hose lines from the lift truck. Typically, only one set of feed ports (front or bottom) is used and the other set is capped off. In some embodiments, the unused feed port fittings may be removed, and the opening capped off flush. In yet other embodiments, the center manifold 382 only has front feed ports or bottom feed ports, but not both. A left positioner hydraulic line 420 couples the center manifold 382 to the left positioner hydraulic port 414 and a right positioner hydraulic line 422 couples the center manifold 382 to the right positioner hydraulic port 416. The center manifold 382 has sequence valves to coordinate the actions of platen positioner 354 and the side shift actuator 172 in the same manner as in the first embodiment handler 100. A left push-pull hydraulic transfer line 428 couples the center manifold 382 to the left beam manifold 378 which couples to the left arm hydraulic line 196. A right push-pull hydraulic transfer line 430 couples the center manifold 382 to the right beam manifold 380 which couples to the right arm hydraulic line 198. These hydraulic lines 420, 422, 428, 430, have sufficient slack so the top hook assembly 356 can be moved between the first set of top hook pin holes 264 for ITA class 3, the second set of top hook pin holes 265 for ITA class 2, and the third set of top hook pin holes 266 (unlocked position) without disconnecting any of these hydraulic lines. Moreover, the center manifold 382 in the second embodiment 400 positions the ports for hydraulic lines 420, 422, 428, 430 a smaller distance below the top hook bar 356 than the ports for the hydraulic lines 320, 322, 328, 330 are below the top hook bar 258 in the first embodiment handler 100. This allows the hydraulic lines 420, 422, 428, 430 to have larger radius bends than the hydraulic lines 320, 322, 328, 330 in the first embodiment handler 100, which provides less friction in hydraulic fluid flow and less wear on the hydraulic lines 420, 422, 428, 430 themselves.

Another difference is the second embodiment handler 400 has a top hook assembly 356 with a top hook bar 358 and a cylinder anchor 386 that have been modified to provide a stronger connection between the cylinder anchor 386 and the upper carriage bar 16. The cylinder anchor 386 has a cylinder anchor crest 392 that protrudes above the rest of the cylinder anchor 386 and provides room for a cylinder anchor tab 390 that is larger and stronger than the cylinder anchor tab 290 in the first embodiment 100. The top hook bar 358 has a top hook bar slot 448 (see FIG. 10A) cut into its back center. The top hook bar slot 448 provides sufficient room for the cylinder anchor crest 392 to protrude above a top hook groove 360 (see FIGS. 9A and 10B) in the top hook bar 358. The top hook bar slot 448 is wide enough to accommodate the cylinder anchor crest 392 as the side shift actuator 172 moves the frame assembly 150 along with the top hook assembly 356 relative to the cylinder anchor 386 and the carriage 14. In the second embodiment 400, the slot 448 is open to the back. In other embodiments, the slot 448 is closed in the back, by a portion of the top hook bar 358 running behind the slot 448 or by a plate attached to the back of the top hook bar 358.

FIG. 10A shows an exploded perspective view of the second embodiment top hook assembly 356. FIG. 10B shows a side view of the second embodiment top hook assembly 356. The top hook bar slot 448 in the top hook bar 358 has already been described elsewhere herein. The left top hook bracket 368 and the right top hook bracket 370 have similar structure and function as the left top hook bracket 268 and left top hook bracket 368 in the first embodiment handler 100. One difference is that the top hook brackets 368, 370 have top hook nuts 458. The top hook assembly 356 has crescent pins 440 instead of top hook pins 262. The crescent pins 440 are configured to engage with the pin holes 264, 265 266. In the second embodiment, the first set of top hook pin holes 264 are shaped to accept insertion of the crescent pins 440 in a first orientation, the second set of top hook pin holes 265 are configured to accept insertion of the crescent pins 440 in a second orientation and the third set of top hook pin holes 266 are configured to accept insertion of the crescent pins 440 in a third orientation. The first set of top hook pin holes 264 will not accept insertion of the crescent pins 440 in the second and third orientations, the second set of top hook pin holes 265 will not accept insertion of the crescent pins 440 in the first and third orientations, and the third set of top hook pin holes 266 will not accept insertion of the crescent pins 440 in the first and second orientations. Each of the crescent pins 440 passes through a lockout sleeve 446, a spring 450 and the top hook nut 458 on its respective side. Each crescent pin 440 is coupled to a knob 444 with a roll pin 442. The interior of the knobs 444 are configured to mate with the hexagonal shape of the top hook nuts 458. The knobs 444 can be pulled outward, drawing the crescent pins 440 with them against the force of the springs 450. Once sufficiently withdrawn, the knobs 444 can each be rotated to one of three different knob positions in which the interior of the knob 444 mates with the hexagonal shape of the top hook nut 458. In a first of these three knob positions, the crescent pins 440 are in the first orientation for insertion into the first set of top hook pin holes 264. In a second of the three knob positions, the crescent pins 440 are in the second orientation for insertion into the second set of top hook pin holes 265. In a third of the three knob positions, the crescent pins 440 are in the third orientation for insertion into the third set of top hook pin holes 266. The knobs 444 have indicia that indicate the positions corresponding to the first, second and third set of top hook pin holes 264, 265, 266 respectively for the ITA class 2 position, ITA class 3 position, and the unlocked position of the top hook assembly 356.

The top hook assembly 356 has safety pins 452 that insert into safety pin holes 456 in the top hook bar 358. Atop portion of the safety pins 452 is wider than a bottom portion of the safety pin holes 456, preventing the safety pins 452 from falling all the way through. A c clip 454 is coupled to a bottom portion of each safety pin 452 to prevent it from being withdrawn completely from the safety pin hole 456. When the knobs 444 are mated to the top hook nuts 458, the safety pins 452 will drop down outboard of the knobs 444 and prevent the knobs 444 and the crescent pins 440 from being drawn outward. To change position of the knobs 444, the operator may push the safety pins 452 upwards into their upper positions, in which the knobs 444 can be drawn outward. As long as the knobs 444 are drawn out, the safety pins 452 cannot drop down to their lower positions. A top portion of the safety pins 452 are marked with a distinct color, such as orange, to indicate to the operator that the top hook assembly 356 is unlocked and may be moved freely up or down the frame towers 230, 232. The lockout sleeves 446 prevent withdrawal of the crescent pins 440 when the knobs 444 are mated with the top hook nuts 458, but do not prevent the withdrawal of the crescent pins 440 when the knobs 444 are drawn outwards.

Easy installation and removal of the push-pull handler 400 to a lift truck 10 is facilitated as follows: The push-pull handler 400 starts sitting off the lift truck 10 with the top hook assembly 356 in the third position (unlocked position). Next, the operator drives the lift truck 10 into the push-pull handler 400 and raises the carriage 14 using the lift cylinder until the weight of top hook assembly 356 is lifted off the crescent pins 440. Then the operator drives the lift truck 10 into the push-pull handler 400 and raises the carriage 14 until weight of top hook assembly 356 is relieved from the crescent pins 440. The operator then pulls the knobs 444 outward, removing them from the third set of top hook pin holes 266 (unlocked position), then turning the knobs 444 to the position corresponding to the desired ITA class and releasing the knobs 444. Now with the knobs 44 in one of the ITA positions the crescent pins 440 can not insert into the third set of top hook pin holes 266. The operator attaches hydraulic lines to the push-pull handler 400. The operator lowers the carriage 14 using the lift cylinder until the crescent pins 440 insert into the selected set of top hook pin holes (264 or 265) and the safety pins 452 drop into place. As the carriage 14 is being lowered, just prior to the crescent pins 440 inserting, the lower carriage bar 16 engages with the bottom hooks 470 (see FIG. 12). At this point the push-pull handler 400 is secured on the lift truck 10 and is hydraulically plumbed and can be used.

An advantage of the second embodiment push-pull handler 400 is that in addition to the sets of top hook pin holes (264, 265) for converting from class 2 to 3, the top hook assembly 356 has an even higher third set of top hook pin holes 266 in which the spread between the top hook bar 358 and the bottom hooks 470 is wide enough for installation without removing the bottom hooks 470. So with a single mechanism the second embodiment push-pull handler 400 facilitates not only re-configuration, but also easier installation. This is enabled by the wide center manifold 382 allowing enough slack for the hosing to travel. The installation is in several ways superior to traditional installation in that it takes an operator only a single instance of getting off the truck to configure the pins in both installation and removal. It also is more ergonomically friendly in that the quick disconnect pins are higher up, so the operator does not have to bend over to the ground (or get under the attachment at all) in order to install the bottom hooks 470.

Another advantage of the second embodiment push-pull handler 400 is the use of the truck lift cylinder as a tool for installation. The top hook assembly 356 is quite heavy, but since it is to be installed a lift truck 10, the operator will have a lift cylinder to use to lift the top hook assembly. 356. This is additionally more ergonomic for installation.

What is claimed is:

1. A load handler configured to be mounted on a lift truck comprising:

a frame assembly comprising a plurality of frame towers;

a top hook assembly configured for coupling with a carriage of the lift truck, wherein the top hook assembly is slidingly coupled with the frame towers; and a securing mechanism, part of the top hook assembly, the securing mechanism when in a first securing mechanism configuration is configured for allowing the top hook assembly to slide along the frame towers until a first top hook position on the frame towers is reached, then securing the top hook assembly in the first top hook position, the securing mechanism when in a second securing mechanism configuration is configured for allowing the top hook assembly to slide along the frame towers until a second top hook position on the frame towers is reached, then securing the top hook assembly in the second top hook position.

2. The load handler of claim 1, further comprising:

wherein the top hook assembly in the first top hook position configures the load handler for mounting to a first type of lift truck carriage; and wherein the top hook assembly in the second top hook position configures the load handler for mounting to a second type of lift truck carriage.

3. The load handler of claim 2, further comprising:

one or more bottom hooks coupled to the frame assembly;

wherein the securing mechanism when in a third securing mechanism configuration is configured for allowing the top hook assembly to slide along the frame towers until a third top hook position on the frame towers is reached, then securing the top hook assembly in the third top hook position, wherein the top hook assembly in the third top hook position is separated from the one or more bottom hooks by a gap, wherein the gap is sufficient to allow insertion of an ITA class 3 lift truck carriage into the gap.

4. The load handler of claim 3, further comprising:

wherein the gap is sufficient to allow insertion of an ITA class 4 lift truck carriage into the gap.

5. The load handler of claim 1, wherein each of the frame towers have a frame tower indentation on a lateral outside of the corresponding frame tower; and wherein the top hook assembly is configured for inserting into the corresponding frame tower indentations, then sliding down the frame towers.

6. The load handler of claim 1, further comprising:

wherein the securing mechanism comprises a first pin;

wherein the plurality of frame towers includes a first frame tower; and wherein the first frame tower has a first tower first pin hole and a first tower second pin hole, wherein the first tower first pin hole is configured to accept insertion of the first pin in a first pin first rotational orientation and the first tower second pin hole is configured to accept insertion of the first pin in a first pin second rotational orientation.

7. The load handler of claim 6, further comprising:

wherein the securing mechanism comprises a second pin;

wherein the plurality of frame towers includes a second frame tower; and wherein the second frame tower has a second tower first pin hole and a second tower second pin hole, wherein the second tower first pin hole is configured to accept insertion of the second pin in a second pin first rotational orientation and the second tower second pin hole is configured to accept insertion of the second pin in a second pin second rotational orientation.

8. The load handler of claim 6, further comprising:

wherein the first tower first pin hole will not accept insertion of the first pin in the first pin second rotational orientation, the first tower second pin hole will not accept insertion of the first pin in the first pin first rotational orientation.

9. The load handler of claim 6, further comprising:

wherein the first tower first pin hole is located on the first frame tower such that when the first pin is inserted in the first tower first pin hole, the top hook assembly is in the first top hook position; and wherein the first tower second pin hole is located on the first frame tower such that when the first pin is inserted in the first tower second pin hole, the top hook assembly is in the second top hook position.

10. The load handler of claim 9, further comprising:

wherein the securing mechanism when in a third securing mechanism configuration is configured for allowing the top hook assembly to slide along the frame towers until a third top hook position on the frame towers is reached, then securing the top hook assembly in the third top hook position;

wherein the first frame tower has a first tower third pin hole configured to accept insertion of the first pin in a first pin third rotational orientation;

wherein the first tower third pin hole is located on the first frame tower such that when the first pin is inserted in the third tower first pin hole, the top hook assembly is in the third top hook position; and wherein the first tower third pin hole is located in a third position on the first frame tower that configures the load handler for removal of the load handler from the lift truck.

11. The load handler of claim 9, further comprising:

wherein the securing mechanism further comprises a knob coupled to the first pin and a spring coupled to the knob, wherein the knob is configured to move laterally outward against a force of the spring and configured to move laterally inward with the force of the spring, wherein the knob is configured for rotating the first pin into different rotational orientations.

12. The load handler of claim 11, further comprising:

wherein the securing mechanism further comprises a safety dowel configured to slidingly pass through a top hook bar of the top hook assembly, the safety dowel is configured to move between an upper dowel position and a lower dowel position;

wherein the securing mechanism is configured to allow the knob to move laterally outward while the safety dowel is in the upper dowel position; and wherein the securing mechanism is configured to allow the safety dowel to drop down into the lower dowel position and block the knob from moving laterally outward while the safety dowel is in the lower dowel position.

13. A load handler configured to be mounted on a lift truck comprising:

a frame assembly;

a cylinder anchor configured for detachably coupling to a carriage of the lift truck;

a top hook assembly detachable coupled to the frame assembly, the top hook assembly configured to be positioned over and in sliding contact with the cylinder anchor and the carriage of the lift truck;

a side shift actuator with a side shift actuator cylinder coupled to the cylinder anchor, the side shift actuator with left and right actuator rods configured to contact the top hook assembly;

a center manifold mechanically and hydraulically directly coupled to the side shift actuator without hydraulic lines;

one or more hydraulic components coupled to the frame assembly; and one or more hydraulic lines, each coupled to the center manifold and coupled to one of the hydraulic components.

14. The load handler of claim 13, wherein the center manifold is mechanically and hydraulically directly coupled to the side shift actuator cylinder with a plurality of threaded fittings.

15. The load handler of claim 13, wherein the center manifold is positioned directly underneath the side shift actuator cylinder.

16. The load handler of claim 13, wherein the center manifold is positioned directly in front of the side shift actuator cylinder.

17. A load handler configured to be mounted on a lift truck comprising:

a frame assembly;

a cylinder anchor configured for detachably coupling to a carriage of the lift truck;

a top hook assembly detachable coupled to the frame assembly, the top hook assembly configured to be positioned over and in sliding contact with the cylinder anchor and the carriage of the lift truck;

a side shift actuator with a side shift actuator cylinder coupled to the cylinder anchor, the side shift actuator with left and right actuator rods configured to contact the top hook assembly;

a center manifold coupled to the side shift actuator;

one or more hydraulic components coupled to the frame assembly;

one or more hydraulic lines, each coupled to the center manifold and coupled to one of the hydraulic components;

a first set of hydraulic input ports configured to be hydraulically coupled to the lift truck, the first set of hydraulic input ports are positioned on an underside of the center manifold; and a second set of hydraulic input ports configured to be hydraulically coupled to the lift truck, the second set of hydraulic input ports are positioned on a front of the center manifold.

18. A load handler configured to be mounted on a lift truck comprising:

a frame assembly;

a cylinder anchor configured for detachably coupling to a carriage of the lift truck;

a top hook assembly detachable coupled to the frame assembly, the top hook assembly configured to be positioned over and in sliding contact with the cylinder anchor and the carriage of the lift truck;

a side shift actuator with a side shift actuator cylinder coupled to the cylinder anchor, the side shift actuator with left and right actuator rods configured to contact the top hook assembly;

a center manifold coupled to the side shift actuator;

one or more hydraulic components coupled to the frame assembly;

one or more hydraulic lines, each coupled to the center manifold and coupled to one of the hydraulic components;

wherein the top hook assembly has a securing mechanism for securing the top hook assembly to the frame assembly in one of a first position that configures the load handler for mounting to a first type of lift truck carriage and a second position that configures the load handler for mounting to second type of lift truck carriage; and wherein the one or more hydraulic lines have sufficient slack so the top hook assembly can be moved between the first position and the second position without disconnecting any of the hydraulic lines.

19. A load handler configured to be mounted on a lift truck comprising:

a frame assembly;

a cylinder anchor configured for detachably coupling to a carriage of the lift truck;

a top hook assembly detachable coupled to the frame assembly, the top hook assembly configured to be positioned over and in sliding contact with the cylinder anchor and the carriage of the lift truck;

one or more hydraulic lines, each have a first portion coupled to the top hook assembly and a second portion coupled to the frame assembly;

wherein the top hook assembly has a securing mechanism for securing the top hook assembly to the frame assembly in one of a first position that configures the load handler for mounting to a first type of lift truck carriage and a second position that configures the load handler for mounting to second type of lift truck carriage; and wherein the hydraulic lines have sufficient slack so the top hook assembly can be moved between the first position and the second position without disconnecting any of the hydraulic lines.

20. A load handler configured to be mounted on a lift truck comprising:

a frame assembly comprising, a left frame tower and a right frame tower;

a cylinder anchor configured for detachably coupling to a carriage of the lift truck;

a top hook assembly comprising a top hook bar coupled to a left top hook bracket and a right top hook bracket, wherein the top hook brackets are slidingly coupled with the frame towers, wherein the top hook bar is configured to be positioned over and in sliding contact with the cylinder anchor and a carriage of the lift truck;

a side shift actuator with a side shift actuator cylinder coupled to the cylinder anchor, the side shift actuator with left and right actuator rods configured to contact the corresponding top hook brackets;

a top hook bar slot in a back center of the top hook bar;

wherein the cylinder anchor has a cylinder anchor crest that protrudes up through the top hook bar slot and above the top hook bar; and wherein the cylinder anchor crest has a cylinder anchor tab configured to nest in an indentation in the carriage of the lift truck.

21. The load handler of claim 20, further comprising:

a top hook retention tab coupled to the cylinder anchor crest that extends forward over the top hook bar.

22. The load handler of claim 20, wherein the top hook bar slot is wide enough to accommodate the cylinder anchor crest as the side shift actuator moves the frame assembly along with the top hook assembly relative to the cylinder anchor and the carriage.

23. The load handler of claim 20, wherein the top hook assembly has a securing mechanism for securing the top hook assembly to the frame towers in one of a first position that configures the load handler for mounting to a first type of lift truck carriage and a second position that configures the load handler for mounting to an second type of lift truck carriage.

24. The load handler of claim 23, wherein the securing mechanism is configured for locking the top hook assembly in the first position when the securing mechanism is set for the first position and the top hook assembly moves into the first position; and wherein the securing mechanism is configured for locking the top hook assembly in the second position when the securing mechanism is set for the second position and the top hook assembly moves into the second position.

* * * * *